US007150681B2

(12) United States Patent
Nilsson

(10) Patent No.: US 7,150,681 B2
(45) Date of Patent: Dec. 19, 2006

(54) DISTANCE MARKER FOR A GOLF COURSE, AND A GOLF COURSE

(76) Inventor: Stieg Nilsson, Fridhemsgatan 29, SE-112 40 Stockholm (SE)

( * ) Notice: Subject to any disclaimer, the term of this patent is extended or adjusted under 35 U.S.C. 154(b) by 0 days.

(21) Appl. No.: 10/499,123

(22) PCT Filed: Dec. 5, 2002

(86) PCT No.: PCT/SE02/02249

§ 371 (c)(1),
(2), (4) Date: Feb. 7, 2005

(87) PCT Pub. No.: WO03/051470

PCT Pub. Date: Jun. 26, 2003

(65) Prior Publication Data

US 2005/0119062 A1 Jun. 2, 2005

(30) Foreign Application Priority Data

Dec. 17, 2001 (SE) ..... 0104257

(51) Int. Cl.
*A63B 69/36* (2006.01)

(52) U.S. Cl. ..... 473/150

(58) Field of Classification Search ..... 473/405, 473/407, 172, 158, 150
See application file for complete search history.

(56) References Cited

U.S. PATENT DOCUMENTS

| | | | | |
|---|---|---|---|---|
| D83,064 | S * | 1/1931 | Sawyer | D21/591 |
| 3,104,879 | A | 9/1963 | Jetton | |
| 3,969,837 | A | 7/1976 | Kresse | |
| 4,006,907 | A | 2/1977 | Heffley, Jr. | |
| 4,572,512 | A | 2/1986 | Tegert | |
| 4,854,579 | A * | 8/1989 | Baxter | 473/407 |
| 5,072,940 | A | 12/1991 | Bailey | |
| 5,163,677 | A | 11/1992 | Foley | |
| 5,163,683 | A | 11/1992 | Oswald | |
| D339,753 | S * | 9/1993 | Dionne | D10/46.1 |
| 5,433,434 | A * | 7/1995 | Helmetsie | 473/446 |
| 5,464,219 | A * | 11/1995 | Bradford et al. | 473/150 |
| 5,626,525 | A * | 5/1997 | Tolley et al. | 473/150 |
| 5,658,210 | A * | 8/1997 | Cornell | 473/407 |
| D412,730 | S * | 8/1999 | Johnson | D21/794 |
| D444,198 | S * | 6/2001 | Monk et al. | D21/794 |
| 2002/0177493 | A1 * | 11/2002 | Harvot et al. | 473/405 |

FOREIGN PATENT DOCUMENTS

| | | |
|---|---|---|
| EP | 0 414 943 A1 | 3/1991 |
| FR | 2 582 529 | 5/1986 |
| GB | 2 312 851 A | 11/1997 |

* cited by examiner

*Primary Examiner*—Mark S. Graham
(74) *Attorney, Agent, or Firm*—Venable LLP; Eric J. Franklin

(57) ABSTRACT

A device for marking a distance to a golf player when playing golf on a golf course, the golf course comprising an area established for striking out a golf ball and an essentially open field, the device comprising a body adapted to be positioned in a visible manner to the golf player in said field and at a definite distance from said area, and a golf course for at least one golf player during golf play, the golf course comprising an area for striking out a golf ball and an essentially open field.

10 Claims, 2 Drawing Sheets

DISTANCE MARKER FOR A GOLF COURSE, AND A GOLF COURSE

TECHNICAL FIELD

The present invention relates to a device for marking a distance to a golf player when playing golf on a golf course, the golf course comprising an area established for striking out a golf ball and an essentially open field, the device comprising a body adapted to be positioned visible to the golf player in said field and at a definite distance from said area. The invention also relates to a golf course comprising such a device and a use of such a device on a golf course.

PRIOR ART

During golf play or during training prior to golf play on a golf course, a golf player strikes a golf ball with a golf club in order to hit a chosen spot on the golf course. In order to achieve that the golf ball drops into the spot the golf player judges the distance to the spot. Said spot is usually in an essentially open field. Thus there are few objects close to the spot, which objects the golf player can use as reference when the golf player judges the distance. Thus, it is difficult for the golf player to judge the distance correctly and to hit the spot with the golf ball. This is especially difficult for beginners who are unused to judging distance or when the golf player is practising on a training golf course, a so called driving range, since a driving range usually does not comprise any trees, shrubs or other objects that the golf player can use as a reference when judging the distance.

The problem with the lack of references can be eased on an ordinary golf course by the golf player using trees and shrubs as references. The problem of using plants as reference is that plants grow and thus change size. Furthermore the problem of judging the distance on an ordinary golf course is facilitated by placing a flag at the holes at the end of the golf courses. Such a flag is difficult to use as a reference for judging the distance since the flagstaff of the flag can be made with varying length, the golf player thus having trouble judging the distance departing from the size of the flag. Furthermore the flagstaff has a small extension in breadth, which in some cases makes the flag difficult to notice and it also makes the size of the flag even more difficult to estimate.

On training golf courses, so called driving ranges, the problem of judging the distance is facilitated by placing signs with numbers indicating the distance from the striking area to the sign. Such signs can also be made in different sizes, hence the golf player cannot use the dimensions of the sign to get an apprehension of the distance, but the golf player can only use the numbers given on the sign. Since the aim of judging the distance to the spot is not to get an absolute measure of the distance, but rather to judge how hard the golf player must strike in order to hit the spot, an intuitive judgement of the distance is preferred, in preference to an exact measure given in meters. Hence, such a sign is difficult to use as a reference in order to facilitate the judgement of the distance, neither is the sign suitable to facilitate the learning of judging distances.

In the patent document U.S. Pat. No. 3,104,879 a training golf course or driving range is shown, provided with various training objects such as golf holes, trees, bunkers and similar. These training objects are to make the golf player find the training golf course more interesting and to give the golf player an incentive for training the judging of distance. The golf course does not comprise any devices or objects intended to facilitate the judgement of the distance or the learning of this, but the training golf course only comprises the objects usually expected on a golf course.

In the patent documents U.S. Pat. Nos. 4,006,907, 4,572,512, 5,163,683, 5,163,677 and GB 2312851 further examples of golf courses are shown.

SUMMARY OF THE INVENTION

The object of the present invention is to indicate a device facilitating for a golf player to judge distances on a golf course such as on a training golf course or on an ordinary golf course. Particularly the object of the invention is to indicate a device letting the golf player to judge intuitively the distance and to train the ability to judge intuitively distances.

This object is achieved with the device as described in the introduction which is characterised in that said body is a full-sized model of an object, the object having a general size known to the golf player, the object being of such a nature that the judgement of the golf player about the distance from said area to the device is simplified departing from the size of said object. The judgement of the distance is facilitated due to the body taking up a smaller angle of vision for the golf player when the body is positioned at a small distance from the golf player than when said body is positioned at a greater distance from the golf player. Since the golf player knows the size of said object and since the body is a model in full size of said object the golf player can judge the distance to the body. Particularly an intuitive judgement of the distance is possible. Thus the judgement of the distance to spots that are close to the body is also facilitated.

Preferably the object is an ordinary object, wherein the probability that more golf players will know the size of the object increases. If the object is an ordinary object the probability that a golf player shall have a correct feeling for the size of the object increases too. Furthermore in order for more golf players to have the essentially same feeling for the size of the object, the object of which the body is a model has an essentially constant extension in height, even for different objects of the same kind. Thus the possibility and ability of the golf player to judge the height of the body and thus the distance to the body increases. For example signs, ladders, houses, plants and flagstaffs can be made or exist in very varying heights and sizes while for example cars, humans and adult animals have essentially constant heights and sizes for different objects of the same kind. Even if for example two cars have different sizes, two cars of the same model have the same size and even if for example a human being can have a somewhat varying size the average size of humans is fairly constant.

That said body is a model of an object instead of putting the object on a golf course directly is advantageous since a model is easier to adapt to the climates and to the demands put forth out on a golf course. A model can also be manufactured with a lower weight wherein the model can be more easily moved between different places on the golf course and the model of an object is often less expensive to manufacture than the object itself.

In one preferred embodiment the object has a certain minimum extension in height, wherein the body is more easily visible at a distance from the body. Preferably the object also has a certain minimum extension in its breadth, wherein the golf player's feeling for the dimensions of the object and the golf player's judgement of the distance to the body is facilitated further. Furthermore, it is easier to make said body visible if the object has a certain minimum width and height. Preferably said object is at least 1 m high and wider than or essentially the same as 10 centimetres.

According to a preferred embodiment of the invention said object is one of a biological being and a vehicle. Golf players usually have a very good feeling for the dimensions of both vehicles and biological beings. Thus bodies that are models of these objects are very well suited as markers for distance. To arrange a body being a model of a vehicle is advantageous because most golf players see vehicles daily. The golf players, at least if they are drivers of vehicle in traffic, are used to judge distance to vehicles.

Arranging a body as a model of a biological being is advantageous since golf players in general are used to judge the distance to biological beings. Since biological beings grow and change size when they are young, models of adult biological beings are preferably used.

According to a further preferred embodiment of the invention said object is a human being. Thus it is very easy for the golf player to relate the size of said object to his own person and thus the golf player has a very good feeling for the size of the object wherein the golf player easily can judge the distance to the body. Humans and thus also golf players have usually great experience in judging the length of other human beings and the distance to those since human beings populate the every day life of the golf player.

According to a further preferred embodiment of the invention said human being is of an essentially average height. Thus the golf players feeling about the size of the object is very consistent with the size of said body. Preferably a model of a human being with average height in the country in which the golf course is located is used. A device in a country with short human beings thus comprises a body that is smaller than a body in a country with mostly taller human beings. Preferably consideration is also taken to which sex the body is a model of.

According to a further preferred embodiment of the invention said body is essentially flat and has a contour shaped to imitate the contour of said object. Thus the volume of the body is less for the same visible surface area, wherein the device is easier to move from one spot to another. According to a preferred embodiment the object is reproduced by said body in such a way that the area of the body is as large as possible wherein the body is well visible and easy to notice. According to another preferred embodiment the object is reproduced by said body in such a way that the object is easily recognisable, that is the contours of the body correspond to the characteristic contour of the object.

According to a further preferred embodiment of the invention the device comprises a first display member indicating the distance between said body and said area. Thus the golf player receives information both about how far the body is from the area, for example in meter, and an idea of the distance departing from the difference between the apprehended size of the body and the golf player's picture in his mind of the size of said object. According to a preferred embodiment of the invention, said first display member is arranged on said body.

According to a further preferred embodiment of the invention the device comprises a second display member arranged for showing information. According to a preferred embodiment of the invention said second display member is arranged on said body. For example the body can be provided with advertising printed on the body or with other kind of information.

According to a further preferred embodiment of the invention the device comprises an anchoring member arranged to anchor the device in said essentially open field.

According to a further preferred embodiment of the invention said golf player can be any golf player. The golf player can thus be a beginner or an experienced golf player and still use the device according to the invention.

A further object of the invention is to indicate a golf course comprising a device to facilitate for a golf player to judge a distance and a use of a device intended to facilitate for a golf player to judge a distance.

This object is achieved by a golf course for at least one golf player during golf play, which golf course comprises an area arranged for striking out a golf ball and an essentially open field, wherein the golf course is characterised in that the golf course comprises at least one device for marking a distance, the device comprising a body positioned visible from said area, in said field and positioned at a definite distance from said area, the body being a full-sized model of an object having a general size known to the player, the object being of such a nature that the judgement of the golf player about the distance from said area to the device is facilitated departing from the size of said object.

According to a preferred embodiment of the invention said device comprises features from any one of the claims 2–10.

The object is further achieved by a use of a device on a golf course for at least one golf player during golf play, which golf course comprises an area established for striking out a golf ball and an essentially open field, wherein the use is characterised in that the golf course comprises at least one device for marking a distance, the device comprising a body positioned visible from said area in said field, and positioned at a definite distance from said area, said body being a full-sized model of an object, the object having a general size known to the golf player, the object being of such a nature that the judgement of the golf player about the distance from said area to the device is facilitated departing from the size of said object.

According to a further preferred embodiment of the invention the use comprises that said device comprises features from any one of the claims 2–10.

DESCRIPTION OF EMBODIMENTS

Figure 1:
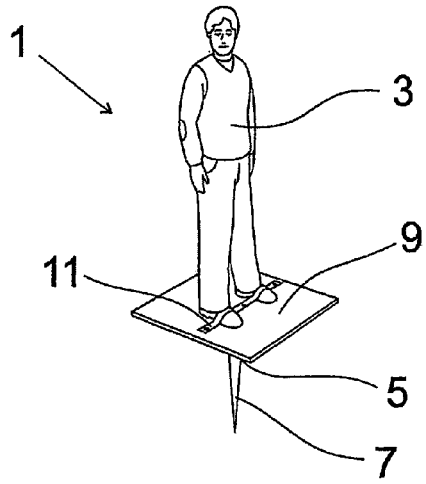
FIG. 1 shows a device comprising a body being a model of a human being.

In FIG. 1 a device according to the invention is shown. The device comprises a body 3 intended to be positioned in a visible manner on a golf course. In this example the body 3 is a full-sized three-dimensional model of a human being of average height.

The device 1 further comprises an anchoring member 5 intended to anchor the body 3 in the ground of the golf course. The anchoring member 5 comprises in this example a spit 7 intended to be driven down into the ground. The anchoring member 5 further comprises a supporting plate 9 connected to the spit 7, the extension plane of the supporting plate 9 being arranged essentially perpendicular to the longitudinal direction of the spit 7. Attachment members 11 are arranged on the supporting plate 9 attaching the body 3 on the supporting plate 9. For example the attachment members 11 can comprise nails nailing the body 3, gripping members gripping the body 3, glue gluing the body 3 to the supporting plate 9, or any other for the purpose known member. The body 3 is in FIG. 1 attached to the supporting plate 9 with straps 11.

The body 3 is intended to be positioned in a visible manner on a golf course at a distance from an area established for striking out a golf ball and in the portion of the golf course extending in the direction in which the golf ball is intended to be struck out. A golf player striking a golf ball in this direction towards the device 1 and said body 3 for the purpose of hitting a specific area in the golf course, for example the area called the green, can easily judge the distance to said area departing from said body 3. This is possible by the body 3 taking up a smaller angle of vision for the golf player when the body is located at a long distance from the golf player than when the body 3 is located at a small distance from the golf player. Since the average height of a human being is known to a golf player and the body 3 is a full-sized model of a human being of average height the golf player can thus easily judge the distance to the body 3 in such a way that the golf player intuitively judges the distance to the body 3. Thus the judgement of the distance to said area is also facilitated, wherein the golf player can hit the target area with the golf ball more easily.

In this example the body 3 is made in plastics but the body can also be made in for example wood, straw, rubber, or some other suitable material known to a person skilled in the art.

Figure 2:
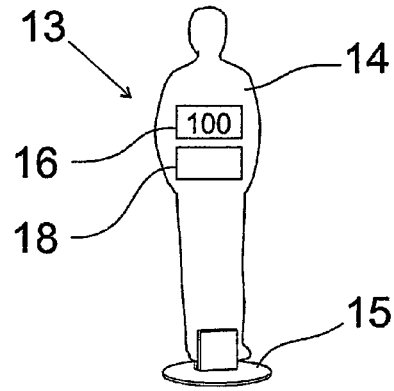
FIG. 2 shows a device comprising an essentially flat body being a model of a human being.

In FIG. 2 a device 13 is shown comprising an essentially flat body 14 being a full-sized model of a human being of average height. The device 13 comprises an anchoring member 15 comprising a slot into which the body is put and attached. The anchoring member 15 further comprises two holes intended for screws, wherein the anchoring member can be screwed onto a bottom plate arranged on the golf course.

The body 14 is provided with a first display member 16 comprising a digital display arranged to indicate the distance between said area and the body by numbers in meter. The body 14 further comprises a second display member 18 comprising a frame and a piece of cardboard put inside the frame. The piece of cardboard is adapted for printing information on the cardboard such as for example printing of advertising.

Figure 3:
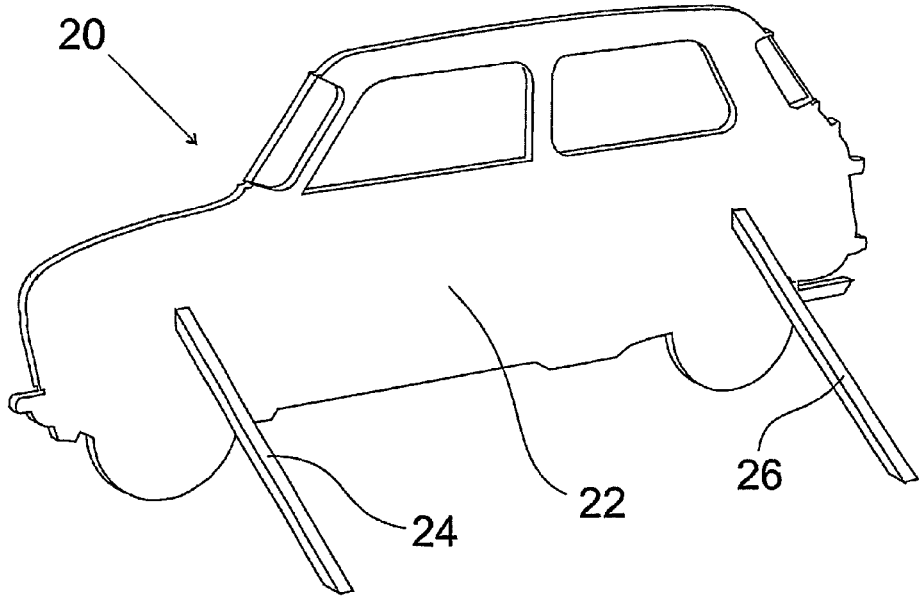
FIG. 3 shows a device comprising an essentially flat body being a model of a private car.

In FIG. 3, a further example of a device according to the invention is shown. In this example the device 20 comprises a body 22 being a full-sized model of a private car. In this example said body 22 is formed as an essentially flat plate, the contour of the body 22 corresponding to the contour of said private car. Advantageously the private car is depicted with said body 22 from a direction allowing the area of the body 22 to become as large as possible. In this example the body 22 is a model of said private car as seen from its side and not straight from the front or from the back. The object can of course also be depicted from another direction wherein the body 22 receives a smaller area.

The device 20 further comprises an anchoring member 24 comprising two stays 26 arranged with one end of the stays 26 resting against the ground of the golf course and with the other end 28 of the stays attached to the body 22. Thus the body 22 rests steadily and upright against the ground by the underside of the body 22 and the support from the stays 26.

In this example the body 22 is made in a wooden plate. For example the wooden plate can be made in plywood, wooden chipboard, or of ordinary boards. The body can also be made in other materials such as for example plastics, cardboard, or metal. Since the body in this example is flat the body becomes light hence the body 22 can easily be moved between different places on the golf course.

The device 22 facilitates the golf player's judgement of the distance to the body 22 in the same ways as for the previously described device 1.

Figure 4:
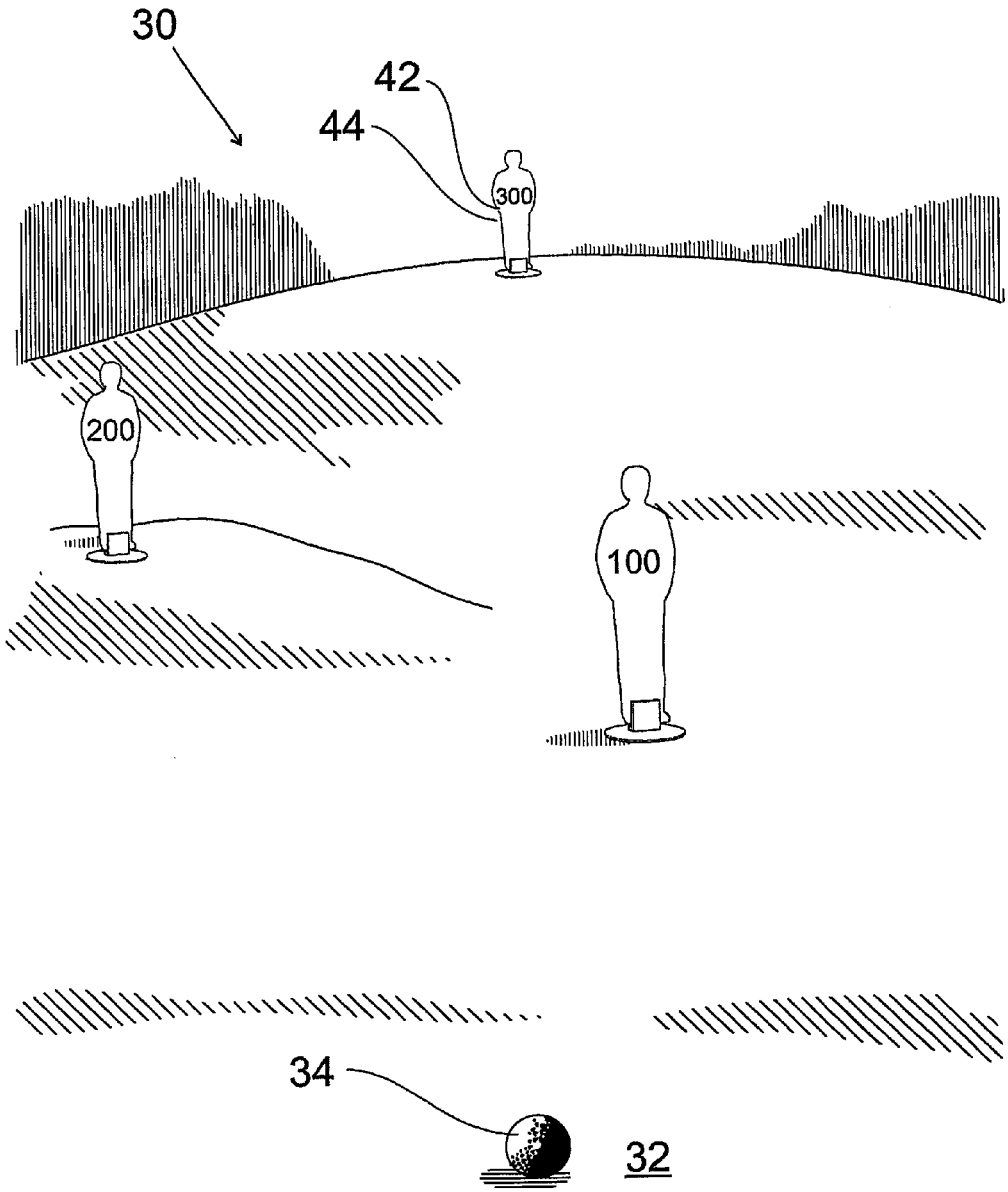
FIG. 4 shows a golf course comprising two devices according to the invention.

In FIG. 4 a view over a golf course 30 is shown from a striking area 32. The golf course is in this example a training golf course, a so called driving range, the golf course 30 comprising several striking areas 32, but in the figure only one striking area 32 is shown for the sake of simplicity. The training golf course 30 is intended for training golf play, wherein a golf player strikes golf balls 34 from said striking area 32 in order to improve his skill in golf. The training golf course 30 is in this example primarily intended to let the golf player train his ability to strike the golf ball 34 far away and his ability to strike the golf ball 34 in such a way that the golf ball drops at a certain distance from the striking area 32. In the last-mentioned case it means that the golf player trains his ability for intuitive judgement of distance.

In order to facilitate for the golf player to train his ability to intuitive judgement of the distance and to improve the possibilities for the golf player to judge intuitively the distance, the golf course 30 according to the invention in this example comprises three devices 42. The devices 42 each comprise an essentially flat body 44, the flat body 44 being formed as an essentially full-sized model of a human being of an essentially average height. The bodies 44 are further formed such that the contour of the flat body 44 essentially corresponds to the contour of the human being.

The devices 42 are positioned on the golf course 30 at different distances from said striking area 32 and on the portion of the golf course extending in the direction into which the golf ball 34 is intended to be struck. The devices 32 facilitate for a golf player to judge the distance from said striking area 32 to said bodies 44 in the same way as described above in connection to the previous drawings. In this example the devices 42 are located at the distances 100 m, 200 m, and 300 m from the striking area 32.

The bodies 44 in the figures are each provided with a display member arranged for displaying at which distance the bodies 42 are located from the striking area 32. Thus the golf player receives both an intuitive apprehension about the distance and an absolute measure of the distance whereby the golf player more easily can learn judging distance.

The embodiments shown herewith shall be seen as non-limiting examples of the invention, which can be varied freely within the scope of the following claims.

For instance, said golf course does not need to be a training golf course, but the golf course may for instance be a usual golf course. Said body may be a model of another object than those described herein, such as for instance a model of a horse. The design of the anchoring member may be varied in a large number of ways, such that a body may be attached to a concrete ball buried in the ground. Also the properties of the display members may be varied. For instance, the display members may be arranged as usual signs, TV screens or lamps arranged in a pattern.

The number of devices on one and the same golf course may be varied as well as the distance and the position of the devices in relation to said striking area. Said bodies may be provided with sharp, self-illuminating or reflecting colours, wherein the bodies become easier to recognise. A device may be provided with lighting and a body with lamps, for instance around the contour of the body or at the top of the body. The body may also be provided with sensors sensing whether the body has been hit by a golf ball, wherein the device may emit a little tune. The device and the golf course, respectively, may be provided with a machinery or equipment for easily moving the devices or for turning them down and putting them up, respectively. To this end, the body may also be attached to the anchoring member by springs or pneumatic.

The invention claimed is:

1. A golf course for at least one golf player when playing golf, the golf course comprising:

an area established for striking a golf ball;

an essentially open field; and at least one device for marking a distance, the device comprising a body positioned in a said field at a distance from said area so as to be visible from said area, wherein the body comprises a full-sized model of a human being, such that a judgement of the golf player about the distance from said area to the device is simplified based upon the size of said body, and the device further comprising a first display member that displays the distance between said body and said area.

2. The golf course according to claim 1, wherein said human being is of an essentially average size.

3. The golf course according to claim 1, wherein said body is essentially flat and has a contour shaped to imitate the contour of said human being.

4. The golf course according to claim 1, wherein said first display member is arranged on said body.

5. The golf course according to claim 1, wherein the device further comprises a second display member arranged for displaying information.

6. The golf course according to claim 5, wherein said second display member is arranged on said body.

7. The golf course according to claim 1, wherein the device further comprises an anchoring member arranged to anchor the device in said essentially open field.

8. A method for facilitating judgement of distances on a golf course, the method comprising:

providing at least one distance marking device comprising a body including a full-sized model of a human being and a first display member;

positioning the at least one distance marking device in an essentially open field at a distance from an area established for striking a golf ball such that the at least one distance marking device is visible from said area for striking a golf ball; and displaying with the first display member the distance between the body and the area for striking a golf ball, thereby facilitating judgement of a golf player about the distance from the area for striking a golf ball based upon the size of the body.

9. The method according to claim 8, further comprising:

providing the distance marking device with a second display member operative to display information.

10. The method according to claim 8, further comprising:

providing the distance marking device with an anchoring member operative to anchor the device in the essentially open field.

* * * * *